US008322148B2

(12) United States Patent
Kim et al.

(10) Patent No.: US 8,322,148 B2
(45) Date of Patent: Dec. 4, 2012

(54) ICE MAKING ASSEMBLY FOR REFRIGERATOR AND METHOD FOR CONTROLLING THE SAME

(75) Inventors: Young Jin Kim, Seoul (KR); Tae Hee Lee, Seoul (KR); Hong Hee Park, Seoul (KR); Ho Youn Lee, Seoul (KR); Joon Hwan Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 959 days.

(21) Appl. No.: 12/379,437

(22) Filed: Feb. 20, 2009

(65) Prior Publication Data

US 2009/0211271 A1 Aug. 27, 2009

(30) Foreign Application Priority Data

Feb. 27, 2008 (KR) ..... 10-2008-0017604

(51) Int. Cl.
*F25C 1/24* (2006.01)
*F25C 5/02* (2006.01)

(52) U.S. Cl. ..... 62/73; 62/233; 62/351

(58) Field of Classification Search ..... 62/73, 131, 62/135, 233, 351, 353
See application file for complete search history.

(56) References Cited

U.S. PATENT DOCUMENTS

| | | | | |
|---|---|---|---|---|
| 2,954,679 | A | 10/1960 | Blackett | |
| 5,187,948 | A | 2/1993 | Frohbieter | |
| 6,688,131 | B1 * | 2/2004 | Kim et al. | 62/353 |
| 2005/0126202 | A1 * | 6/2005 | Shoukyuu et al. | 62/351 |
| 2006/0201170 | A1 | 9/2006 | Cole | |
| 2007/0130982 | A1 | 6/2007 | Wang | |
| 2009/0211267 | A1 * | 8/2009 | Kim et al. | 62/66 |
| 2009/0211270 | A1 * | 8/2009 | Kim et al. | 62/71 |

* cited by examiner

*Primary Examiner* — Marc Norman
(74) *Attorney, Agent, or Firm* — McKenna Long & Aldridge LLP

(57) ABSTRACT

Ice making assembly for a refrigerator and a method for controlling the ice making assembly. The ice making assembly and method capable of more effectively providing transparent ice. The ice making assembly and method also capable of preventing water overflow.

18 Claims, 6 Drawing Sheets

ICE MAKING ASSEMBLY FOR REFRIGERATOR AND METHOD FOR CONTROLLING THE SAME

The present application claims priority under 35 U.S.C. 119 and 35 U.S.C. 365 to Korean Patent Application No. 10-2008-0017604 (filed on Feb. 27, 2008), which is hereby incorporated by reference in its entirety.

BACKGROUND

The present disclosure relates to an ice making assembly for a refrigerator and a method for controlling the ice making assembly.

Refrigerators are domestic appliances used for storing foods by refrigerating or freezing the foods. Recently, various kinds of refrigerators have been introduced into the market. Examples of recent refrigerators include: a side by side type refrigerator in which a refrigerator compartment and a freezer compartment are disposed on the left and right sides; a bottom freezer type refrigerator in which a refrigerator compartment is disposed above a freezer compartment; and a top mount type refrigerator in which a refrigerator compartment is disposed under a freezer compartment.

Furthermore, many of the recently introduced refrigerators have a home bar structure. These permit users to access foods or drinks disposed inside a refrigerator compartment through the home bar (i.e., a relatively small access portal) without having to open the larger refrigerator door.

Refrigerators typically employ a number of refrigeration-cycle components. These include a compressor, a condenser, and an expansion member disposed inside the refrigerator. An evaporator is typically disposed on the backside of the refrigerator main body.

In addition, an ice making assembly may be provided. The ice making assembly may be mounted in the freezer compartment, the refrigerator compartment, on the freezer compartment door, or on the refrigerator compartment door.

To satisfy consumers' increasing demands for transparent ice, ice making assemblies are now being designed to produce ice that is very clear and not cloudy. Accordingly much research has been conducted on ice making assemblies that can provide transparent ice.

Known related art ice making assemblies generally employ an additional water tank disposed at a predetermined side of the refrigerator. It is connected to the ice making tray through a tube which supplies water to the ice making tray. Alternatively, the ice making tray may be directly connected to a tap (i.e., external water source) through a tube.

SUMMARY

The exemplary embodiments of the present invention provide for an ice making assembly for a refrigerator that can more easily produce transparent ice and maintain the amount of water supplied for making ice at a constant level for each ice making cycle. Said embodiments also provide for a method for doing the same.

The exemplary embodiments also provide for an ice making assembly for a refrigerator having a water supply that is automatically interrupted to prevent overflow when the water supplied to an ice making tray reaches a set level. Said embodiments also provide for a method for doing the same.

The exemplary embodiments further provide for an ice making assembly for a refrigerator that can maintain the water supply at a constant level regardless of water pressure variations, and a method for doing the same.

The exemplary embodiments still further provide for an ice making assembly for a refrigerator that can reduce unnecessary power consumption by rapidly detecting a water supply error which may result when water is not supplied to the ice making tray due to, for example, a malfunction of a water supply valve. These embodiments also provide a method for doing the same.

In one exemplary embodiment, an ice making assembly includes a tray, accommodated in the refrigerator, which in turn include a plurality of ice recesses for receiving water; a plurality of fins above the tray; and a plurality of rods disposed through the fins to absorb heat from the water in the ice recesses, wherein the rods and the tray are used as electrodes and are electrically connected to each other when water in the ice recesses reaches a set level.

In another exemplary embodiment, there is provided a method for controlling an ice making assembly of a refrigerator, the method includes disposing a rod vertically at an upper side of a tray, in which an ice recess is formed; moving the rod downward into the ice recess to a predefined height conducive for making ice supplying water to the ice recess; and controlling the amount of water such that the water reaches a pre set level that achieves an electrical connection between the rod and the tray.

It will become apparent from the following disclosure that the ice making assembly and the method of controlling an ice making assembly according to the present disclosure, more easily produces transparent ice. It will also be apparent from the disclosure that water can be supplied at a constant level for each ice making cycle regardless of water pressure variations at the installed location of the refrigerator. Therefore, overflowing of supplied water, freezing of overflowed water in the refrigerator, and outflow of overflowed water from the refrigerator can be prevented.

Further, in accordance with the present invention, while different amounts of water may remain in the ice recesses of the tray, water can be supplied to the ice recesses such that the final water level is the same.

Still further, when water is not supplied to the tray due to a malfunction of the water supply valve, the exemplary embodiments of the present invention are capable of rapidly detecting this situation and reducing unnecessary power consumption.

In addition, the ice making assembly can detect the level of water using existing components without using any additional devices so that the manufacturing costs of the ice making assembly can be reduced.

The exemplary embodiments are fully described in the accompanying drawings and the description below. Other features will be apparent from the description and drawings, and from the claims.

DETAILED DESCRIPTION OF THE EMBODIMENTS

Hereinafter, an ice making assembly for a refrigerator will be described in detail according to exemplary embodiments of the present disclosure with reference to the accompanying drawings. In the following description, an ice making assembly is mounted at a freezer compartment door. However, the ice making assembly can alternatively be mounted at other places such as the freezer compartment, the refrigerator compartment, and on the refrigerator compartment door.

Figure 1:
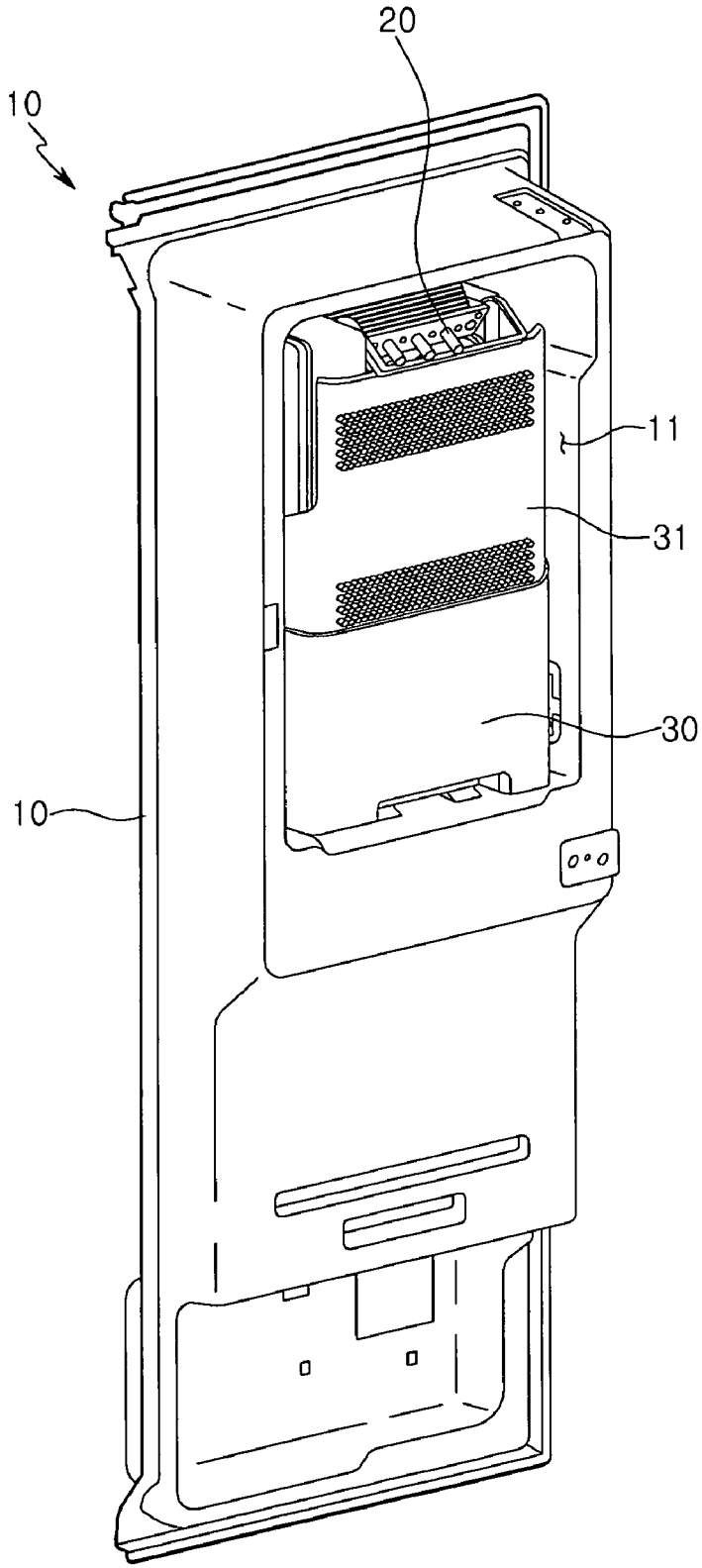
FIGS. 1 and 2 are perspective views illustrating an ice making assembly structure for a refrigerator according to an exemplary embodiment of the present invention.
Figure 2:
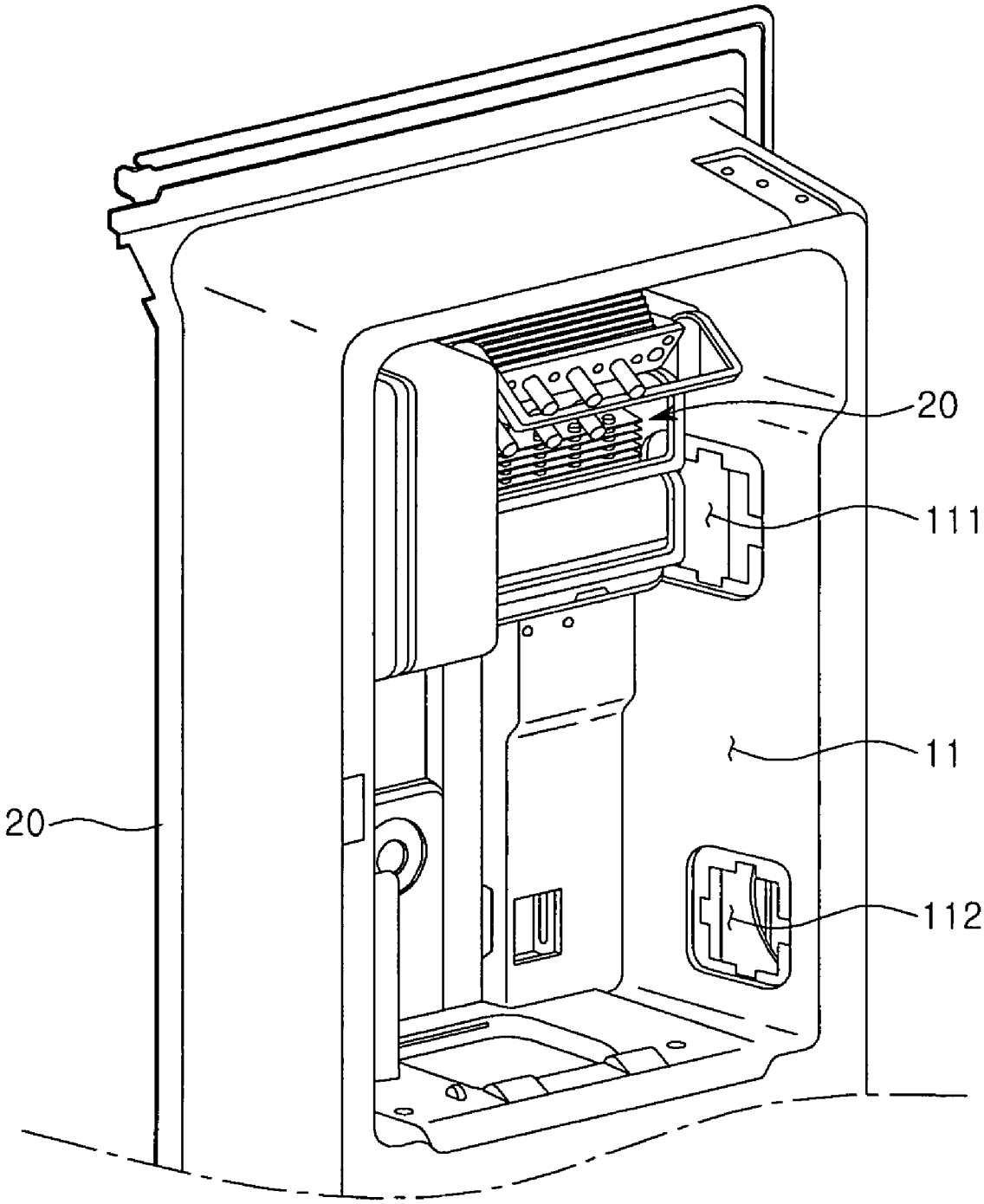

FIGS. 1 and 2 are perspective views illustrating an ice making assembly structure for a refrigerator according to exemplary embodiments of the present invention. As shown, an ice making assembly 20 is mounted on the backside of a door 10, and the backside of the door 10 is recessed to form an ice making assembly space 11 for accommodating the ice making assembly 20. A cooling air supply hole 111 is formed at a side of the ice making assembly space 11 for allowing the inflow of cooling air from an evaporator (not shown), and a cooling air discharge hole 112, formed in the side of the ice making assembly space 11, for allowing the cooling air to be discharged from the ice making assembly space 11 to the evaporator.

The ice making assembly 20 is mounted at an upper portion of the ice making assembly space 11, and a container 30 is mounted under the ice making assembly 20 to store ice made by the ice making assembly 20. The ice making assembly 20 is protected by an ice making cover 31. In addition, owing to the ice making cover 31, ice, when separating from the ice making assembly 20, does not spill outward. It instead falls cleanly into the container 30.

Figure 3:
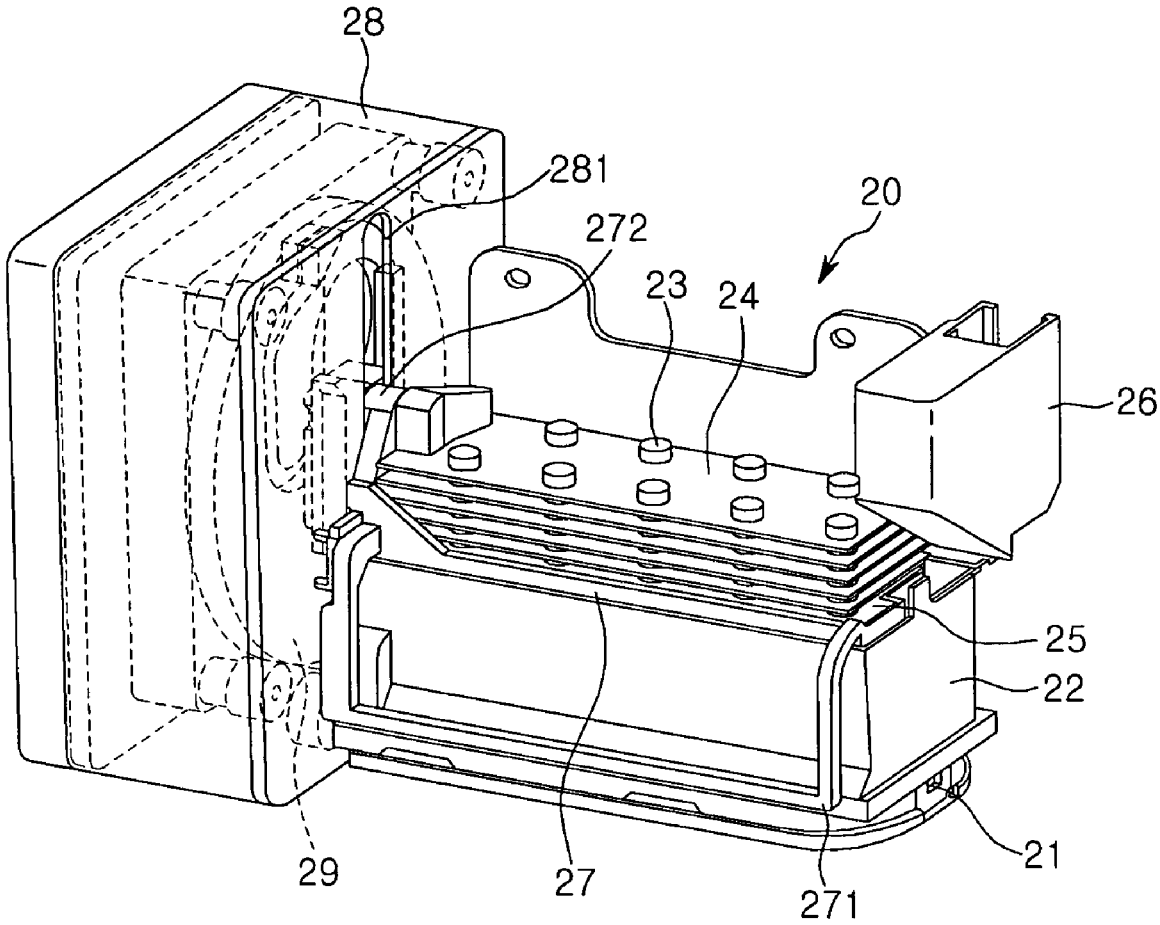
FIG. 3 is a perspective view illustrating in more detail an ice making assembly according to the exemplary embodiments.
Figure 4:
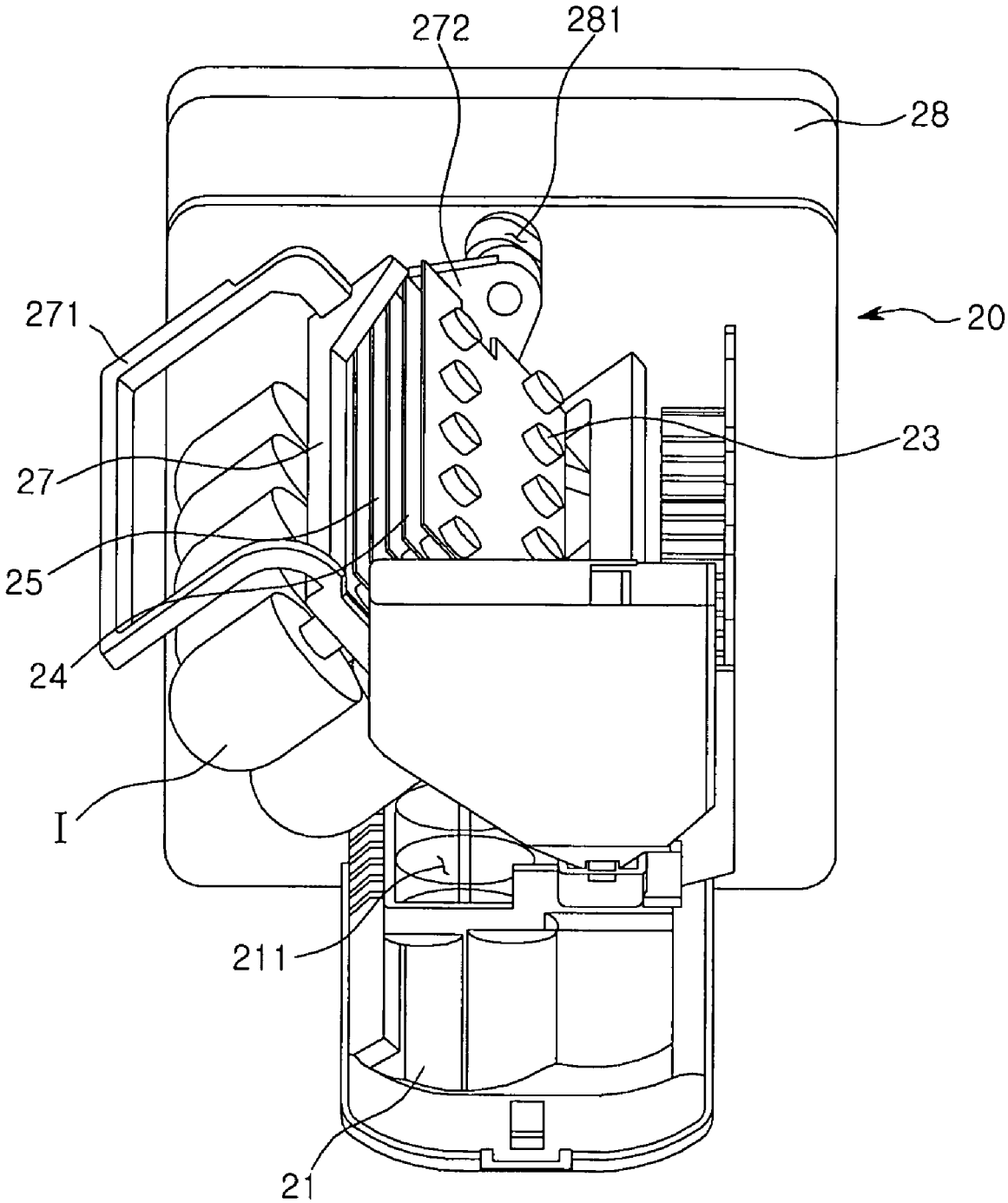
FIG. 4 is a perspective view illustrating the ice making assembly just before ice is transferred to a container.

FIG. 3 is a perspective view illustrating the ice making assembly 20 according to exemplary embodiments of the present invention, and FIG. 4 is a perspective view illustrating the ice making assembly 20 just before ice is transferred to the container 30. As shown, the ice making assembly 20 includes a tray 21 having a plurality of ice recesses 211 for making ice in a predetermined shape; a plurality of fins 24 rotatably and movably stacked above the tray 21; a plurality of rods 23 configured to be inserted into the ice recesses 211 through the fins 24; an ice ejecting heater 25 provided at the lowermost fin 24; a supporting plate 27 configured to support the ice ejecting heater 25, the fins 24, and the rods 23 as one unit; a water supply part 26 disposed at an end of the tray 21; and a control box 28 disposed at the opposite end of the tray 21.

A heater (not shown) is mounted at the bottom of the tray 21 to maintain the tray 21 at a temperature higher than freezing. A supporting lever 271 extends from the front of supporting plate 27, and a hinge 272 is formed at one end of the supporting plate 27. During an ice making operation, as shown in FIG. 4, ice (I) having a shape corresponding to the shape of the ice recesses 211 are formed around the rods 23.

Referring again to FIG. 3, a cam 29 and a driving motor for actuating the cam 29 are disposed inside the control box 28. The hinge 272 is connected to the cam 29 so that the hinge 272 can be lifted and rotated by the movement of cam 29. The ice ejecting heater 25 may be form in the shape of a plate and it contacts the rods 23. Alternatively, the ice ejecting heater 25 may be contained inside the rods 23. The supporting plate 27 also serves as a top for tray 21 such that water supplied to the tray 21 is indirectly cooled by the cooling air supplied to the ice making assembly space 11.

Hereinafter, the ice making and ice ejecting operation of the ice making assembly 20 will be described. First, the aforementioned heater attached to tray 21 maintains the tray 21 at a temperature higher than 0° C. This facilitates the process of making transparent ice in the ice making assembly 20 as described in greater detail below.

More particularly, because water is rapidly frozen by cooling air supplied by an evaporator in accordance with known ice making assemblies, air dissolved in the water is trapped in and cannot be discharged from the water during freezing. Consequently, the water freezes with gas dissolved in the water, and this results in cloudy (i.e., non-transparent) ice.

Accordingly, the tray 21 in accordance with exemplary embodiment of the present invention is maintained at a temperature higher than freezing, thus the water freezes slowly so that air dissolved in the water has time to escape the water before the water is frozen. The resulting ice is transparent, not cloudy.

Towards the beginning of the ice making process, the rods 23 are inserted in the ice recesses 211 of the tray 21. Water is then supplied to the tray 21, and the freezing operation begins after the supply of water is completed. The freezing operation begins when cooling air is supplied to the ice making assembly space 11. The temperature of the fins 24 is then reduced to a temperature below freezing by the supplied cooling air. The temperature of the rods 23 is also reduced to a temperature below freezing through conduction with the fins 24. A Portions of each rod 23 is submerged in the water; therefore, the water is gradually frozen beginning with the water located closest to the rods 23. Eventually, water located further from the rods 23 also freeze.

After the water freezing operation is completed, cam 29 is rotated to move the rods 23 out of the ice recesses 211. That is, the cam 29 is rotated to lift the rods 23, and after the ice (I) is removed from the ice recesses 211, the cam 29 is further rotated causing the rods 23 to tilt at a predetermined angle. More specifically, the rotation of the cam 29 causes the hinge 272 to rotate. The rotation of the hinge 272, in turn, causes the rods 23 to tilt at a predetermined angle. When the rods 23 are tilted at a predetermined angle, as shown in FIG. 4, the ice ejecting heater 25 begins operating.

The ice ejecting heater 25 causes the temperature of the rods 23 to increase. This causes the ice (I) to separate from the rods 23. The ice (I) then falls into the container 30.

Figure 5:
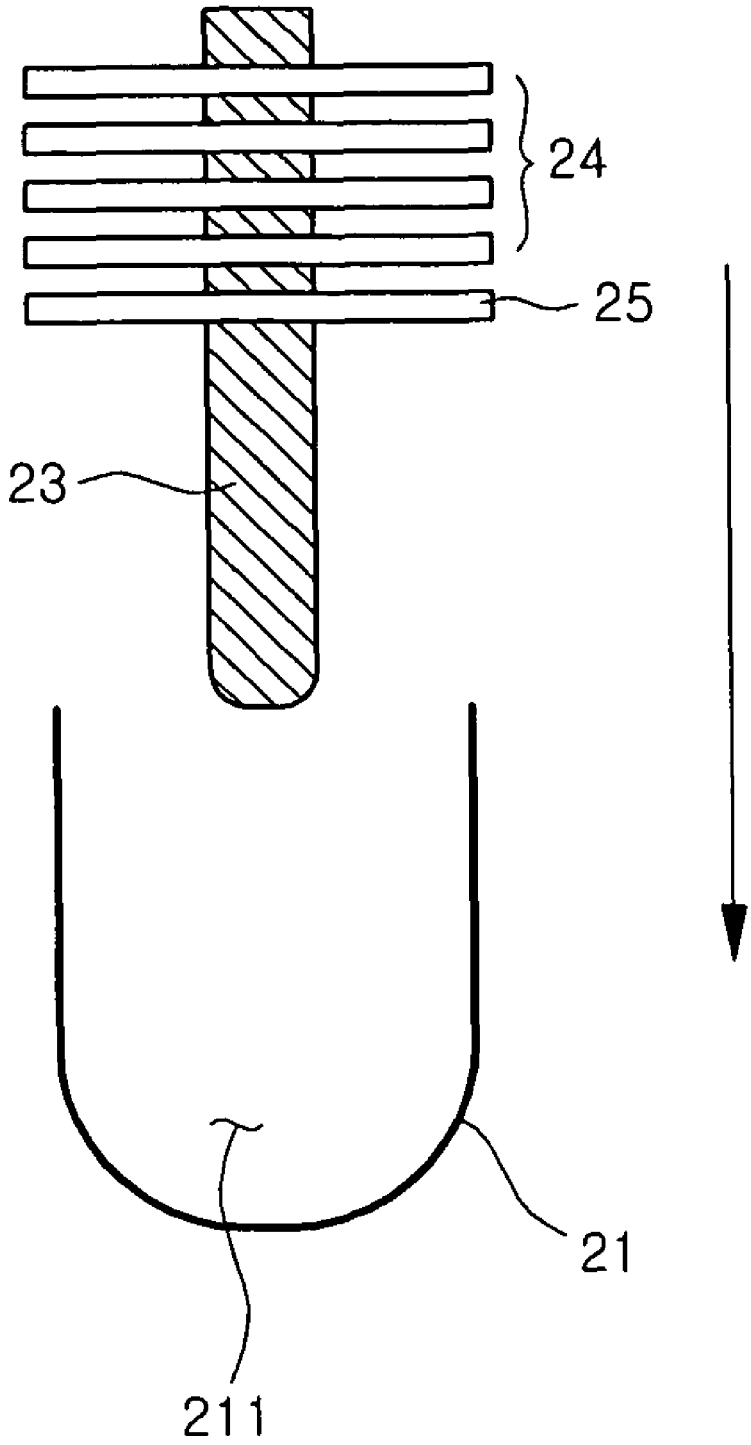
FIGS. 5 and 6 illustrate the method of detecting the water level for the ice making tray according to exemplary embodiments.
Figure 6:
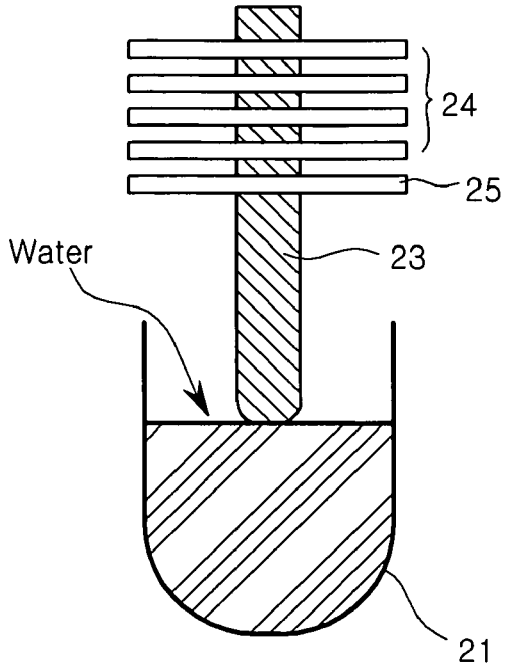

FIGS. 5 and 6 illustrate an exemplary method of detecting the level of the water supplied to tray 21 according to a exemplary embodiments of the present invention. As shown, the ice making assembly 20 detects water level using the rod 23 and the tray 21 without the need for any additional water level detecting sensor.

More specifically, rod 23 and tray 21 are configured to function as electrodes, thus, when tray 21 is filled with water, the resistance of the water between the rod 23 and the tray 21 is measured to determine water level.

As shown in FIG. 5, rod 23 is moved downward into the ice recess 211 of tray 21 until rod 23 reaches a set position. Water is then supplied to the ice recess 211. As shown in FIG. 6, when the ice recess 211 is filled with water to the set level, the lower end of the rod 23 makes contact with the water in the ice recess 211. Next, the level of the water in the ice recess 211 can be detected by measuring the resistance of the water between the tray 21 and the rod 23. As such, water can be precisely supplied to the set level. In addition, if there is no current between the tray 21 and the rod 23 after water is supplied for a predetermined time, it can be determined that there is a water supply error, and thus a malfunction associated with the ice making assembly 20 can also be detected.

Figure 7:
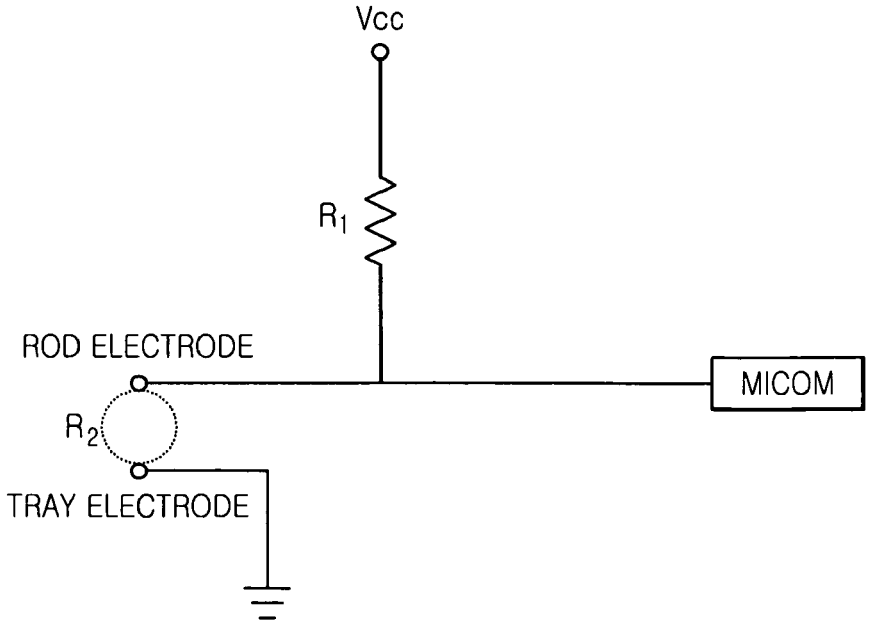
FIG. 7 is a circuit diagram illustrating a water level detecting circuit provided in the ice making assembly according to exemplary embodiments.

FIG. 7 is a circuit diagram illustrating a water level detecting circuit for the ice making assembly according to exemplary embodiments of the present invention. As shown, a rod electrode and a tray electrode are provided at one side of the water level detecting circuit, where the tray electrode is grounded. A control unit MICOM is provided as shown, and a reference voltage Vcc is provided by a power supply. A resistor R1 is disposed between a reference voltage terminal and the control unit. Before water is supplied to the ice recess 211, the reference voltage Vcc is detected by the control unit. When water is supplied to the ice recess 211 to a set level, the rod electrode and the tray electrode are electrically connected, and a resistor R2 forms, by virtue of the water between the rod and tray electrodes. Then, the control unit detects the voltage, different from the reference voltage VCC, across R2. The voltage across R2 is proportional to the amount of water present. Thus, the control unit can determine when the ice recess 211 is filled with water to the set level.

When the rod and tray electrodes are electrically connected, the voltage detected by the control unit can be expressed by the following equation.

$$V=Vcc\times R2/(R1+R2)$$

Referring to the above equation, when the ice recess 211 is not filled with water, air fills the space between the rod and tray electrodes, and since the resistance of air is practically infinite, V=Vcc. However, when water is supplied to the ice recess 211 and the rod 23 makes contact with the water, the water acts like a resistor R2 between the rod and tray electrodes. Because the resistance of water is smaller than that of air, the control unit detects a voltage V across R2 that is smaller than the reference voltage Vcc (V<Vcc), and thus the level of water can be determined from the voltage drop at the control unit.

After it is determined that water is supplied to a set level, the supply of water is interrupted, and the rod 23 is further moved downward into the ice recess 211. Then, the water supplied to the ice recess 211 is frozen by rod 23 which is cooled by the cooling air. The freezing of the water proceeds from the outer surface of the rod 23 to the inner surface of the ice recess 211.

Further in accordance with the exemplary embodiments of the present invention, the position of the rods relative to the ice recesses may be user adjustable. For example, the user may have an option to select the size of the ice that is produced by the ice making assembly, through the use of a selection button and a corresponding control circuit. The position of the rods relative to the ice recesses is then adjusted as a function of the user's selection. If the user wants the ice making assembly to produce small sized ice, it will be understood, from the preceding disclosure that the position of the rods will be automatically set relative far down in the ice recesses. Accordingly, when water is supplied to the tray, a relatively small amount of water will be required to achieve an electrical connection between the rods and the tray. When the connection is achieved, the control circuit, such as the control circuit illustrated in FIG. 7, stops the water supply and smaller sized ice is ultimately produced as less water was used to fill the tray. If the user instead chooses medium or large sized ice, the rods will not be positioned as far down in the ice recesses as was the case with smaller sized ice, thus allowing a greater amount of water to be supplied to the tray, resulting in larger sized ice.

Although exemplary embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice making assembly for a refrigerator, comprising:
- a tray accommodated in the refrigerator and comprising a plurality of ice recesses for receiving water to be frozen;
- a plurality of fins above the tray; and
- a plurality of rods disposed through the fins for absorbing heat from the water filled in the ice recesses,
- wherein the rod and the tray are used as electrodes and are electrically connected to each other when water supplied to the ice recess reaches a set level, so that a level of the water is detected.

2. The ice making assembly of claim 1, wherein the ice making assembly is disposed at a freezer compartment door.

3. The ice making assembly according to claim 1, wherein when water supplied to the ice recess reaches to the set level, a resistor is formed by the water between the rod and the tray.

4. The ice making assembly according to claim 1, wherein the fins have a plate shape and are stacked at predetermined intervals.

5. The ice making assembly according to claim 4, wherein the fins are cooled by cooling air supplied to the tray, and the rods are cooled to below a freezing temperature by conduction with the fins.

6. The ice making assembly according to claim 1, wherein the fins and the rods are provided as one unit and are configured to be lifted and then rotated after a freezing operation.

7. The ice making assembly according to claim 1, further comprising:
- a supporting plate configured to support the fins and the rods as one unit; and
- a supporting lever extending and/or bent from an end of the supporting plate.

8. The ice making assembly according to claim 1, wherein at least one of the fins is an ice ejecting heater.

9. The ice making assembly according to claim 1, wherein a heater is buried in the rods.

10. The ice making assembly according to claim 1, wherein a heater is buried in the tray or attached to a surface of the tray.

11. A method for controlling an ice making assembly of a refrigerator, the method comprising:
- disposing a rod vertically at an upper side of a tray in which an ice recess is formed;
- moving the rod downward into the ice recess to a height corresponding to a level set for making ice;
- supplying water to the ice recess; and
- allowing the water to reach the set level for electrical connection between the rod and the tray.

12. The method according to claim 11, wherein when the rod and the tray are electrically connected by the water, a resistor is formed by the water between the rod and the tray such that a voltage variation is detected by a control unit.

13. The method according to claim 12, wherein when the control unit detects the voltage variation, the control unit determines that the water is supplied to the set level.

14. The method according to claim 12, further comprising:
- stopping the supplying of the water when the control unit detects the voltage variation; and
- moving the rod further down into the ice recess.

15. The method according to claim 14, further comprising:

stopping the rod when the rod is moved down to a set position; and freezing the water by supplying cooling air.

16. The method according to claim 15, wherein during the freezing of the water, the tray is kept at a temperature higher than a freezing temperature.

17. The method according to claim 15, wherein after the freezing of the water, the method further comprises:

lifting the rod;

rotating the rod by a predetermined angle after the rod is lifted to a set height; and heating the rod to separate ice from the rod.

18. The method according to claim 11, wherein if water is not supplied to the set level within a predetermined time after water is supplied, a water supply error signal is generated.

* * * * *